US008925884B2

(12) United States Patent
Schultz et al.

(10) Patent No.: US 8,925,884 B2
(45) Date of Patent: Jan. 6, 2015

(54) LIGHT FIXTURE SUPPORT ASSEMBLY

(71) Applicant: Cree, Inc., Durham, NC (US)

(72) Inventors: Russell Steven Schultz, Union Grove, WI (US); Don Miletich, Franklin, WI (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/740,880

(22) Filed: Jan. 14, 2013

(65) Prior Publication Data

US 2014/0197291 A1 Jul. 17, 2014

(51) Int. Cl.
*F21V 21/00* (2006.01)
*F21V 21/116* (2006.01)

(52) U.S. Cl.
CPC ..... *F21V 21/116* (2013.01)
USPC ..... 248/230.1; 362/419

(58) Field of Classification Search
USPC ..... 248/511, 514, 538, 540, 541, 230.1, 248/230.3, 342, 343, 344; 362/319–325, 362/418–433
See application file for complete search history.

(56) References Cited

U.S. PATENT DOCUMENTS

| | | | | |
|---|---|---|---|---|
| 1,225,301 | A | | 5/1917 | Wolfe |
| 2,974,219 | A | | 3/1961 | Husby |
| 3,071,683 | A | | 1/1963 | Queale |
| 3,184,199 | A | | 5/1965 | Clark et al. |
| 3,233,094 | A | | 2/1966 | Foulds |
| 3,652,047 | A | | 3/1972 | Starr |
| 3,660,651 | A | | 5/1972 | Miles, Jr. |
| 3,685,858 | A | * | 8/1972 | Wandler ..... 285/27 |
| 4,167,033 | A | | 9/1979 | Fletcher |
| 4,264,946 | A | | 4/1981 | Faux, Sr. |
| 4,426,676 | A | | 1/1984 | Taylor |
| 4,787,019 | A | | 11/1988 | van den Broeke |
| 4,793,581 | A | | 12/1988 | Bilson et al. |
| 5,136,493 | A | | 8/1992 | Straus et al. |
| 5,896,288 | A | | 4/1999 | Lecheler et al. |
| 6,045,239 | A | | 4/2000 | Waldmann |
| 6,056,254 | A | | 5/2000 | Albright et al. |
| 6,155,701 | A | | 12/2000 | Leen |
| 6,357,895 | B1 | | 3/2002 | Kierulf et al. |
| 6,502,967 | B2 | | 1/2003 | Mullen |
| RE38,767 | E | | 8/2005 | Wedell et al. |
| 6,959,996 | B2 | | 11/2005 | Ip |
| 7,703,939 | B2 | | 4/2010 | Wilcox et al. |
| 8,021,026 | B2 | | 9/2011 | Liu et al. |
| 8,104,933 | B2 | | 1/2012 | Liu et al. |

(Continued)

OTHER PUBLICATIONS

Philips Roadway Lighting. Product Brochure. Date: Copyright 2010. 12 pages.

*Primary Examiner* — Steven Marsh
(74) *Attorney, Agent, or Firm* — Jansson Munger McKinley & Shape Ltd.

(57) ABSTRACT

A mounting assembly for securing a fixture in a desired orientation. The assembly includes a fulcrum and an opposing structure each secured with respect to the fixture and positioned to receive a support member therebetween. The fulcrum defines a fulcrum plane and is positioned to pivotably engage one side of the support member. The assembly also includes at least one adjustable engager separately secured to the opposing structure for engaging the support member at position spaced from the fulcrum plane such that, when the support member is received between the fulcrum and the engager, adjustment of the engager holds the fixture in the desired orientation. In some embodiments, the fixture is a luminaire.

27 Claims, 9 Drawing Sheets

(56) References Cited

U.S. PATENT DOCUMENTS

2011/0222284 A1 9/2011 Kong et al.
2012/0300480 A1* 11/2012 Kim et al. ..... 362/419
2013/0093236 A1* 4/2013 Marshall et al. ..... 299/10

* cited by examiner

LIGHT FIXTURE SUPPORT ASSEMBLY

FIELD OF THE INVENTION

This invention relates generally to fixture supports and, more particularly, to supports for luminaires mounted with respect to elongate support members such as tenons or pipes.

BACKGROUND OF THE INVENTION

In the field of lighting, light fixtures are needed in many different settings, and for area lighting a high position often allows the most efficient use of light. There are many ways of supporting light fixtures with respect to fixed surfaces, such as light poles and walls. As larger light fixtures are used for illuminating large areas, light fixtures typically increase in size and weight and may be difficult to handle and install, especially at high elevations. Fixture-supporting structures such as tenons or pipes may not be at a perfect desired angle, and therefore fixtures have to be adjusted during installation to assure the desired fixture orientation.

Luminaires may have shapes and designs which limit space to accommodate structures for mounting purposes. A simple mounting assembly which is unobtrusive, does not interrupt liminaire aesthetics, permits easy installation and easy orientation adjustment would be desired.

SUMMARY OF THE INVENTION

The present invention is a mounting assembly for securing a fixture with respect to a support member in a desired orientation. The assembly includes a fulcrum and an opposing structure each secured with respect to the fixture and positioned to receive the support member therebetween. The fulcrum defines a fulcrum plane and is positioned to pivotably engage one side of the support member. The assembly also includes at least one adjustable engager separately secured to the opposing structure for engaging the support member at position spaced from the fulcrum plane such that when the support member is received between the fulcrum and the engager, adjustment of the engager holds the fixture in the desired orientation.

The fixture may be a luminaire. The support member may be an elongate pipe or tenon extending from a static structure such as a light pole or a wall of a building.

In some embodiments, the opposing structure is a portion of a mount housing secured with respect to the fixture for receiving the support member therein. The mount housing may include a fixture-adjacent end wall and a surrounding wall which extends from the end wall and includes the opposing structure.

In certain embodiments, the mount housing has a longitudinal axis and includes an angle-referencing region shaped to engage the fixture-adjacent end of the support member to facilitate positioning thereof at one of plural predetermined angle ranges with respect to the longitudinal axis of the mount housing.

In some of such embodiments, the mount housing includes a fixture-adjacent end wall and a surrounding wall which extends from the end wall and includes the opposing structure. The angle-referencing region may have a step-like configuration adjoining the end wall with steps each corresponding to one of the plural predetermined angle ranges.

In such embodiments, the predetermined angle ranges may include −5°, 0° and +5° such that, depending on which of the steps is selected for engagement by the fixture-adjacent end of the support member, adjustment of the adjustable engager locks the support member at a particular angle within the range of the selected step.

The assembly may include a pair of the adjustable engagers each separately secured to the opposing structure for engaging the support member at positions opposite the fulcrum, one on either side of the fulcrum plane.

In certain embodiments, the fulcrum is part of a fulcrum member having a mounting portion secured to the end wall and an extension portion extending from the mounting portion along the surrounding wall to the fulcrum which protrudes from the extension portion. The fulcrum may be shaped to limit lateral movement of the support member thereagainst. The fulcrum may include a row of teeth configured to engage the support member.

The adjustable engager may include a yoke shaped to substantially conform to the shape of the support member.

In some of the embodiments with the pair of the adjustable engagers, the adjustable engagers are spaced brackets adjustably secured with respect to the opposing structure. Each of the spaced brackets may have a yoke for engagement with the support member, the yoke being positioned at a selected distance with respect to the opposing structure.

In certain embodiments, for each yoke, the mounting assembly includes at least one adjustment pin in threaded engagement with the opposing structure for pushing the corresponding yoke against the support member. The adjustment pin may hold the corresponding bracket at a selected distance with respect to the opposing structure. The mounting assembly may include a pair of adjustment pins for each yoke, one at each end of the yoke.

In some of these embodiments, each yoke has a pin-receiving aperture through which a corresponding pin extends to terminate in a distal end beyond the yoke. There may be a ring-engaging feature at the distal end of the pin and a retaining ring held on the pin by the ring-engaging feature to retain the yoke on the pin prior to engagement of the yoke with the support member.

In certain embodiments, each adjustment pin has first and second ends and includes a threaded shank and a shaft portion extending from the threaded shank the second end. The threaded shank extends from the first end in threaded engagement with the opposing structure. The shaft portion has the ring-engaging feature at the second end. The retaining ring is held on the pin by the ring-engaging feature. The first end of the pin may be headless and have a wrench-engaging recess.

In some of such embodiments, the pin(s) extend(s) through the opposing structure such that the pin may be fully recessed into the opposing structure, thus reducing visibility of the mounting hardware while allowing for tilt adjustability of the fixture.

DETAILED DESCRIPTIONS OF EXEMPLARY EMBODIMENTS

Figure 7:
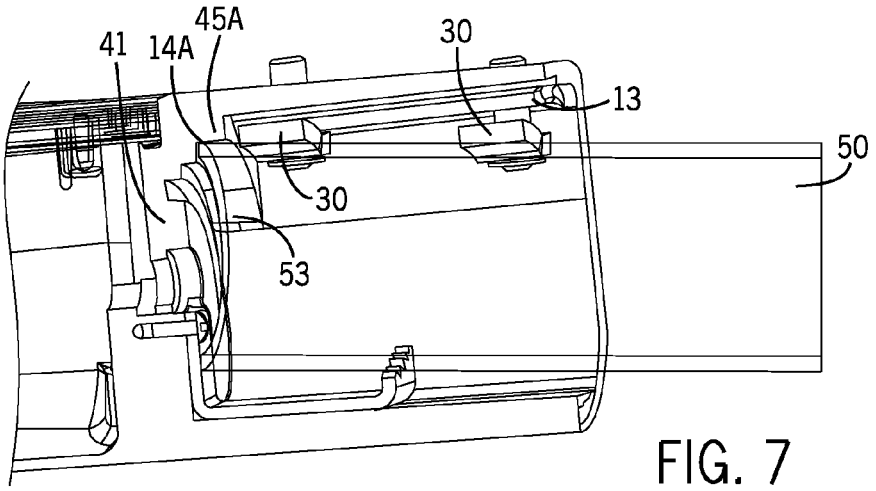
FIGS. 7-9 are cross-sectional perspective views taken along the lines 3-3 and showing the pipe at different angles with respect to the mount housing.
Figure 8:
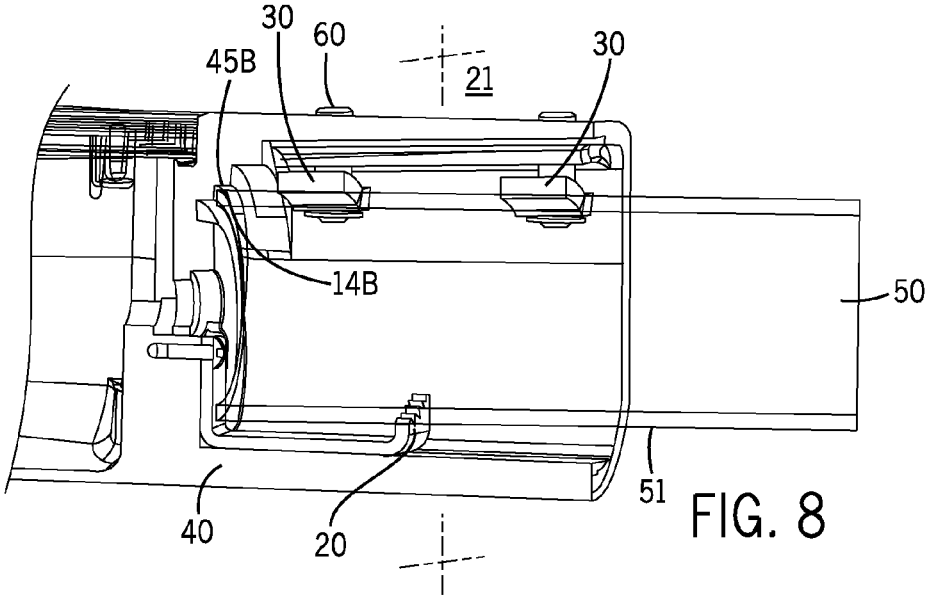
Figure 9:
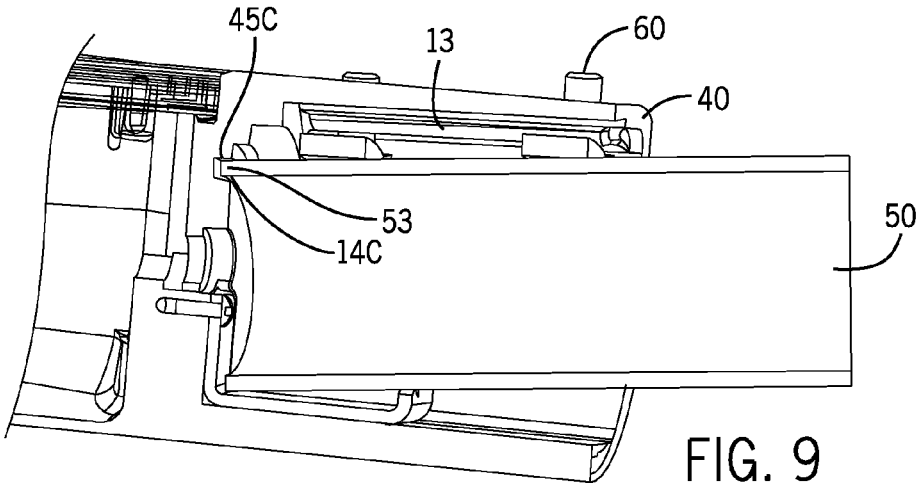
Figure 10:
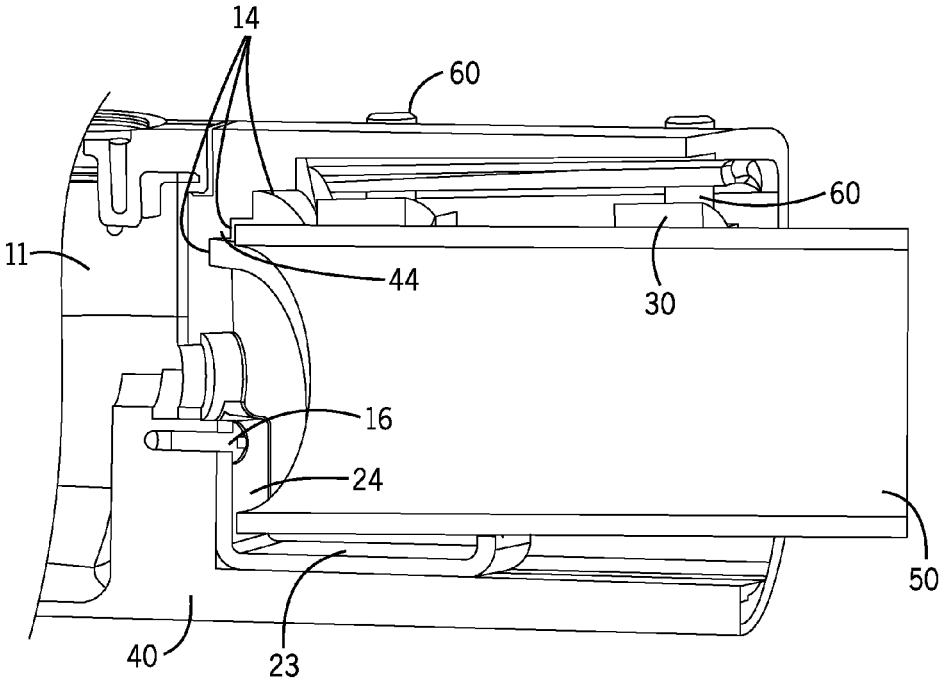
FIG. 10 is yet another cross-sectional perspective view taken along lines 3-3 seen in FIG. 2.
Figure 11:
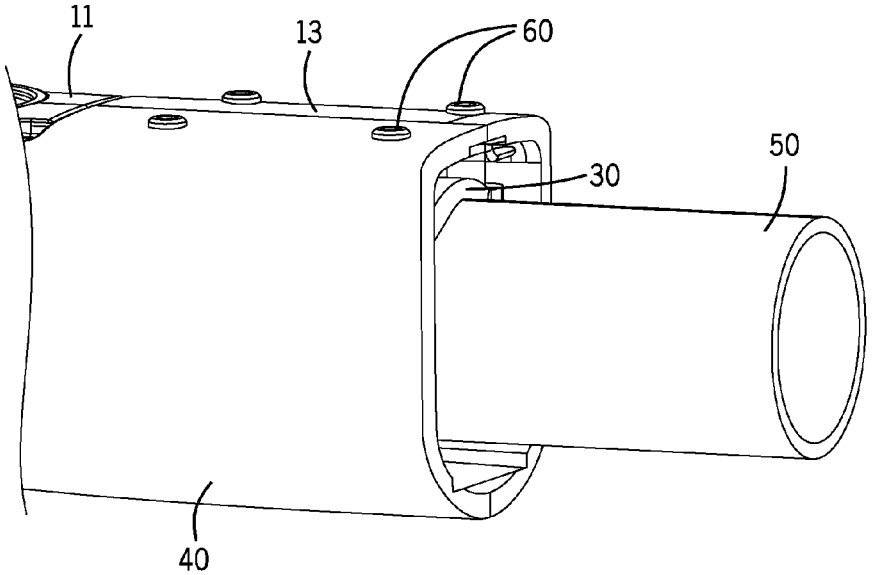
FIG. 11 is an opaque perspective view of the mounting assembly of FIG. 1.
Figure 14:
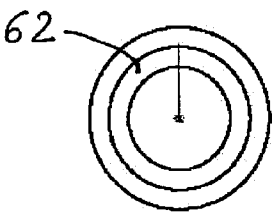
FIG. 14 is an enlarged plan view of a second end of the adjustment pin.
Figure 15:
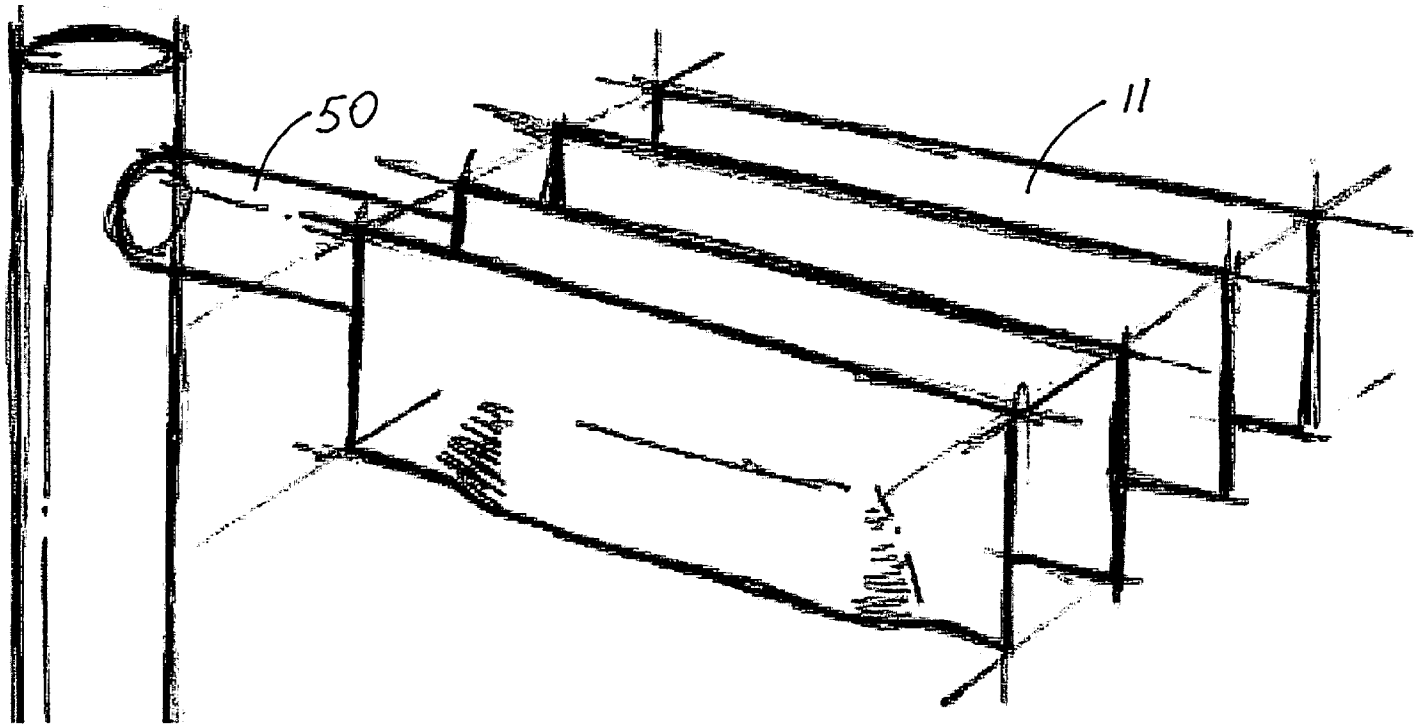
FIG. 15 is schematic sketch illustrating an example of a luminaire mounted with respect to a tenon extending from an pole.

FIGS. 1-14 illustrate an exemplary embodiment of a mounting assembly 10 for securing a fixture 11 with respect to an support member 50 in a desired orientation. Assembly 10 includes a fulcrum 20 and an opposing structure 13 each secured with respect to fixture 11 and positioned to receive support member 50 therebetween. As seen in FIG. 8, fulcrum 20 defines a fulcrum plane 21 and is positioned to pivotably engage one side 51 of support member 50. FIGS. 1-14 show assembly 10 including a pair of adjustable engagers 30 secured with respect to opposing structure 13, one on each side of fulcrum plane 21 and positioned for sandwiching support member 50 against fulcrum 20. FIGS. 7-9 illustrate each adjustable engager 30 being configured for locking support member 50 in such position with respect to fixture 11 that holds that fixture 11 is in the desired orientation. FIG. 15 shows fixture 11 as luminaire.

Fixture 11 may also be an apparatus which requires securement to a tenon or pipe-like elongate support. Such fixture may be related to illumination or other field. The elongate support member may be oriented at such angle which is dictated by the fixture function, including support members extending horizontally, vertically or at any angle in between.

Figure 1:
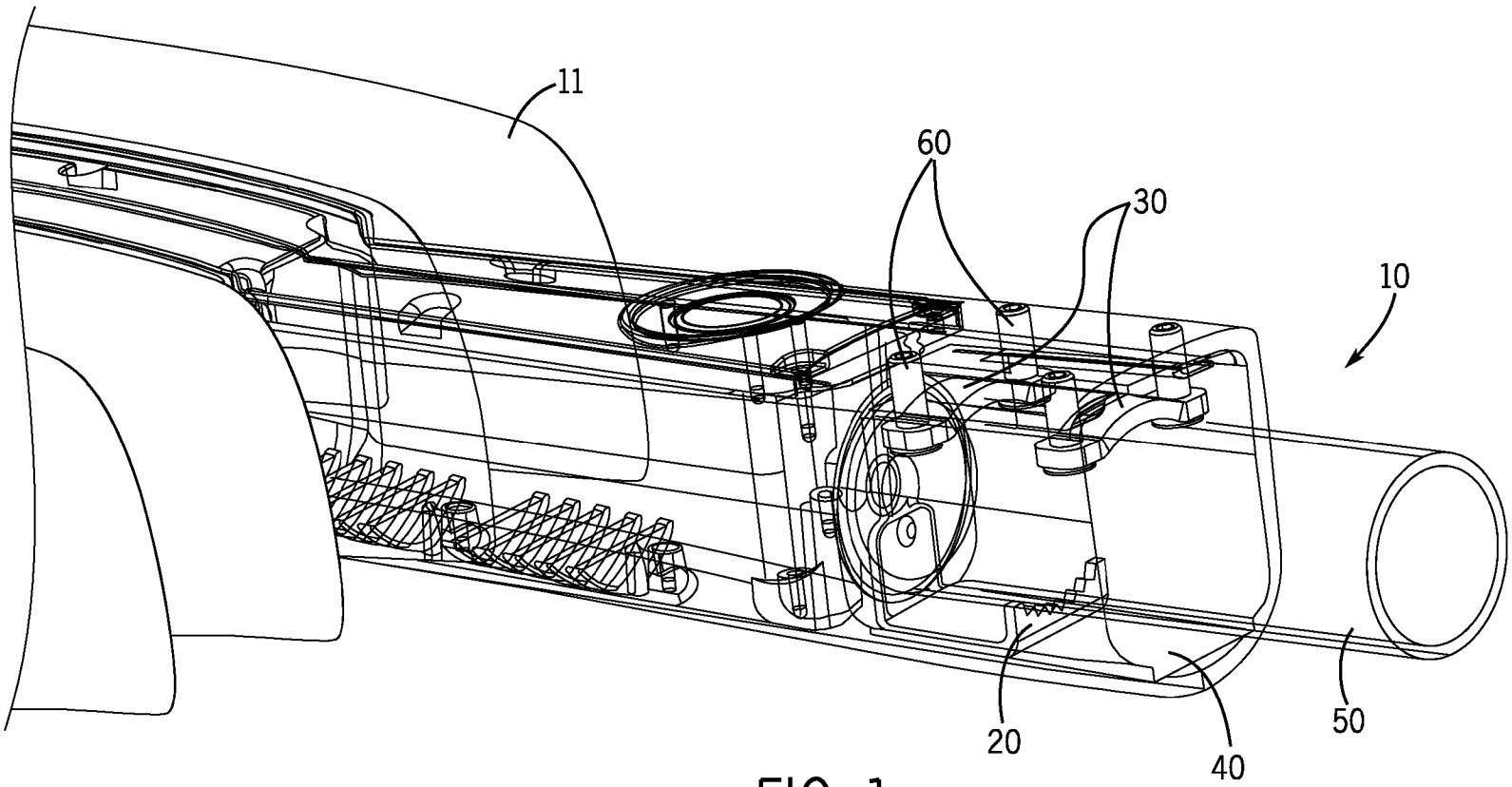
FIG. 1 is a partially transparent perspective view of an exemplary embodiment of the inventive fixture mounting assembly.
Figure 2:
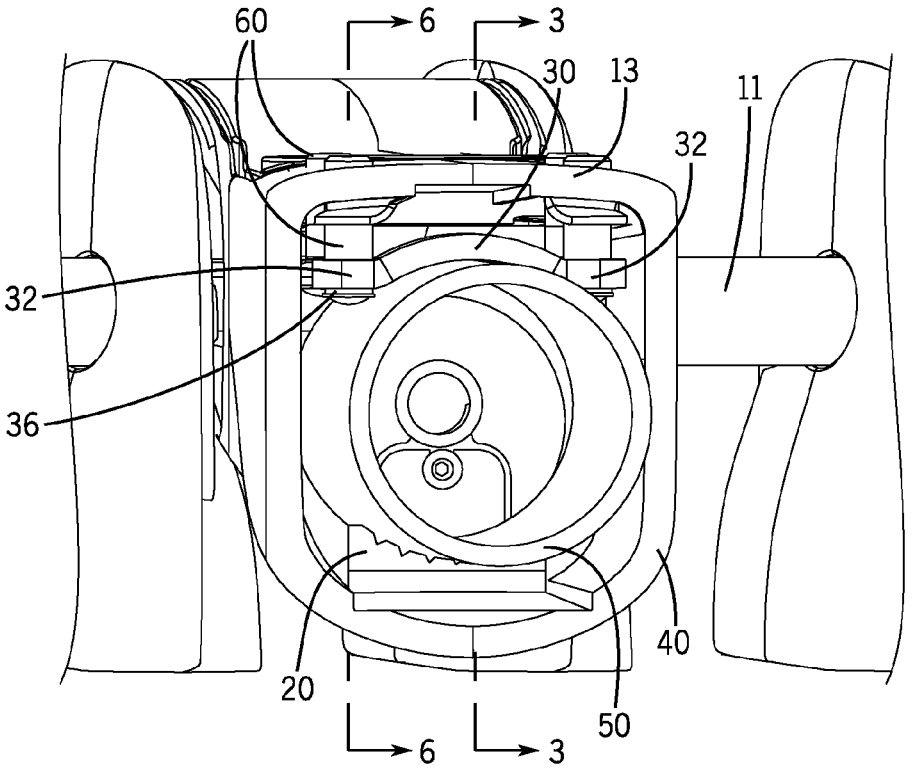
FIG. 2 is a rear perspective view of the mounting assembly of FIG. 1.
Figure 3:
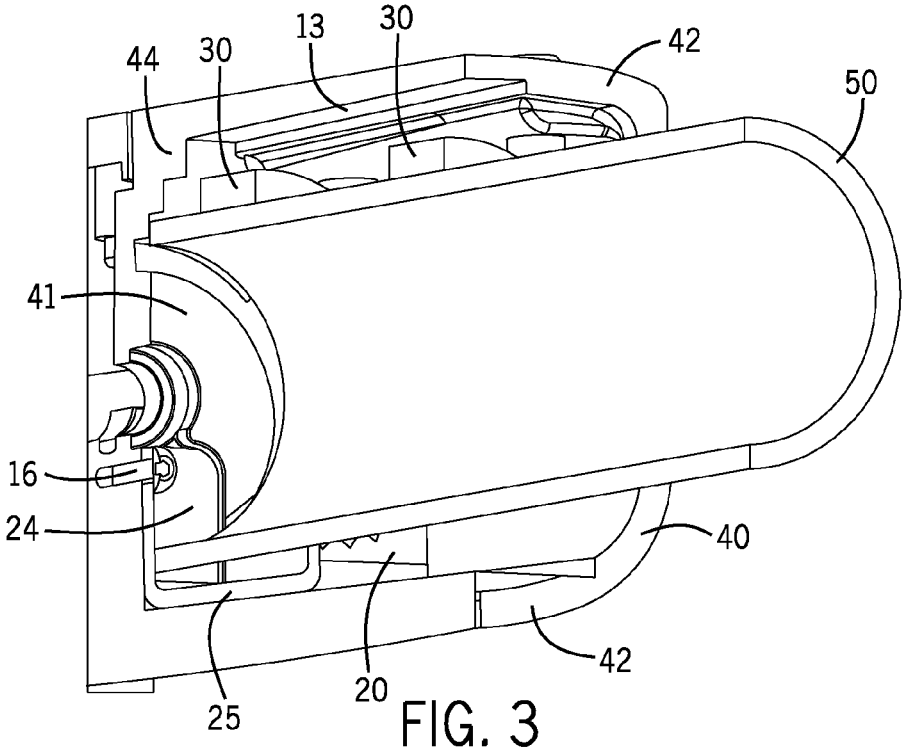
FIG. 3 is a cross-sectional perspective view of the mounting assembly of FIG. 1 taken along lines 3-3 seen in FIG. 2.
Figure 4:
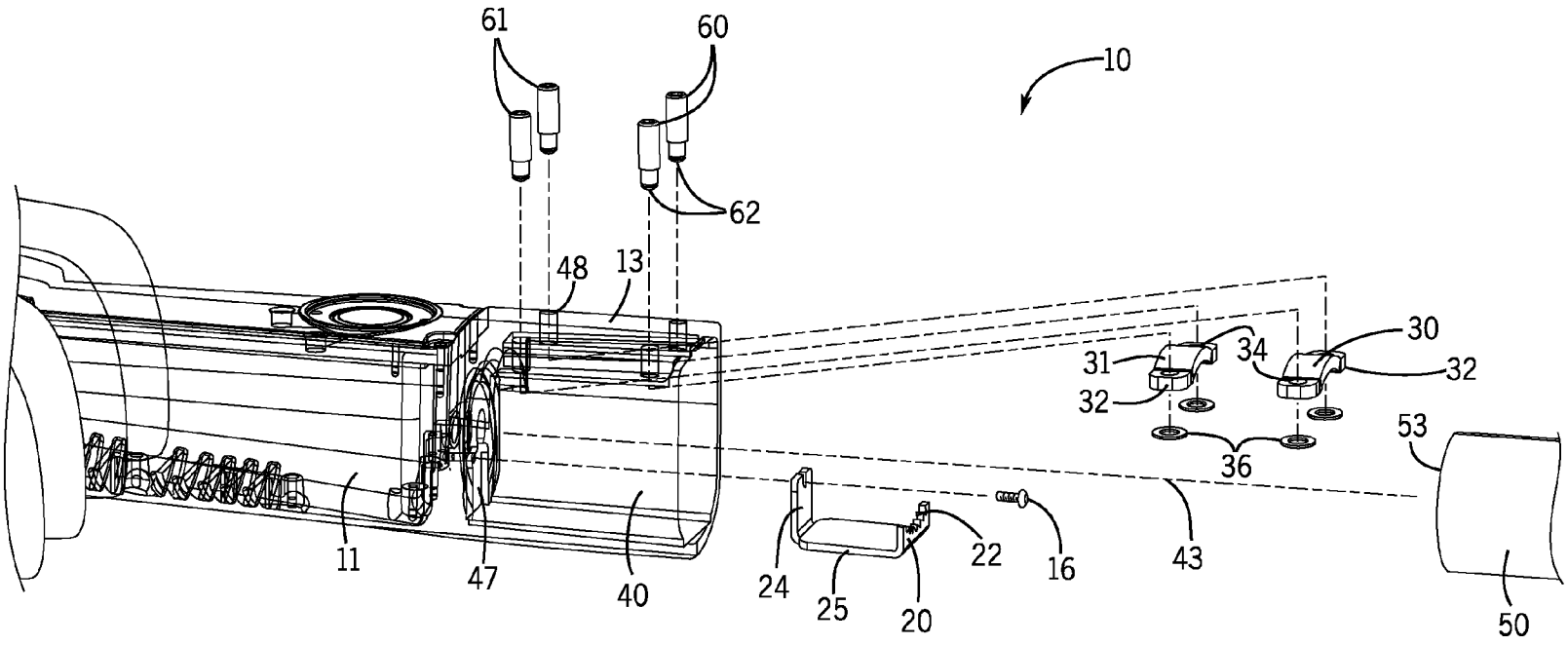
FIG. 4 is an exploded perspective view of the mounting assembly of FIG. 1.
Figure 5:
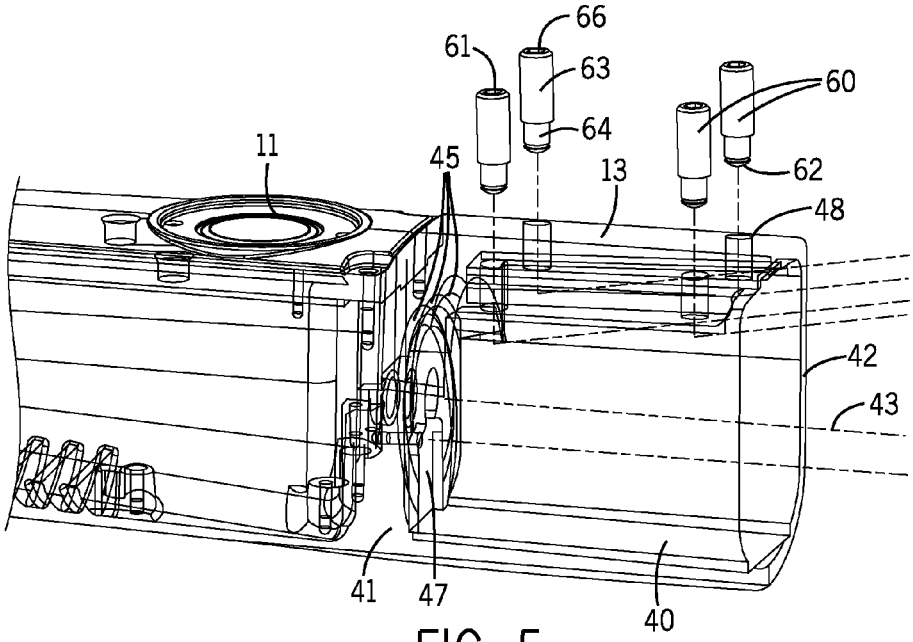
FIG. 5 is a fragment of the exploded perspective view of FIG. 4.

FIGS. 1-11 further illustrate opposing structure 13 as a portion of a mount housing 40 secured with respect to fixture 11 for receiving support member 50 therein. FIGS. 3 and 5 show mount housing 40 including a fixture-adjacent end wall 41 and a surrounding wall 42 which extends from end wall 41 and includes opposing structure 13. Mount housing 40 is shown as a separate structure. Such separate structure of mount housing 40 is shown as a single piece which may be formed by casting or by any other suitable method. Alternatively, the opposing structure may be a part of the fixture. In some of such alternative embodiments, the mount housing may include walls of the fixture housing. FIGS. 1-4 and 6-10 show fulcrum 20 as part of a fulcrum member 23 which has a mounting portion 24 secured to end wall 41 and an extension portion 25 which extends from mounting portion 24 along surrounding wall 42 and terminates with fulcrum 20 which protrudes from extension portion 25. Extension portion 25 is shown against a fulcrum-supporting surface 49 of surrounding wall 42. Mounting portion 24 is shown secured to end wall 41 with a self-tapping screw 16 or by any other suitable means. FIGS. 3 and 5 also show end wall 41 having a recess 47 conforming the shape of mounting portion 24 which is positioned within recess 47 facilitating installation of fulcrum member 23 in proper orientation.

FIGS. 4 and 5 show mount housing 40 having a longitudinal axis 43. FIGS. 3-10 also illustrate mount housing 40 including an angle-referencing region 44 shaped to engage fixture-adjacent end 53 of support member 50 to facilitate positioning thereof at one of plural predetermined angle ranges 14 with respect to longitudinal axis 43 of mount housing 40. FIGS. 7-9 show angle-referencing region 44 as a step-like configuration adjoining end wall 41 with steps 45 each corresponding to one of plural predetermined angle ranges 14. Such predetermined angle ranges 14 may include range 14A which includes about −5° to about 0°, range 14B which includes about 0° to less than about +5° and range 14C which includes about +5°.

FIG. 7 shows step 45A selected for use by fixture-adjacent end 53 of elongate support member 50 and engagers 30. FIG. 7 shows mount housing 40 adjusted within range 14A of step 45A and locked at about −5° with respect to support member 50.

FIG. 8 shows step 45B selected for use by fixture-adjacent end 53 of support member 50 and engagers 30. FIG. 8 shows mount housing 40 adjusted within range 14B of step 45B and locked at 0° with respect to support member 50. FIG. 9 shows step 45C selected for use by fixture-adjacent end 53 of support member 50 and engagers 30. FIG. 9 shows mount housing 40 adjusted within range 14C of step 45C and locked at +5° with respect to support member 50.

FIGS. 7-9 illustrate fixture-adjacent end 53 of support member 50 butted against both surfaces of each step 45. Such positioning facilitates orientation of fixture 11 with longitudinal axis 43 of mount housing 40 being positioned at exactly −5°, 0° or +5 with respect to support member 50. However, support member 50 may also be positioned such that axis 43 is within ranges 14A, 14B and 14C at angles other than −5° , 0° or +5 with respect to support member 50 by carefully adjusting spacing of adjusters 30 with respect to opposing structure 13. If necessary, even grater range of angles may be achieved by spacing fixture-adjacent end 53 of support member 50 away from angle-referencing region 44.

Figure 6:
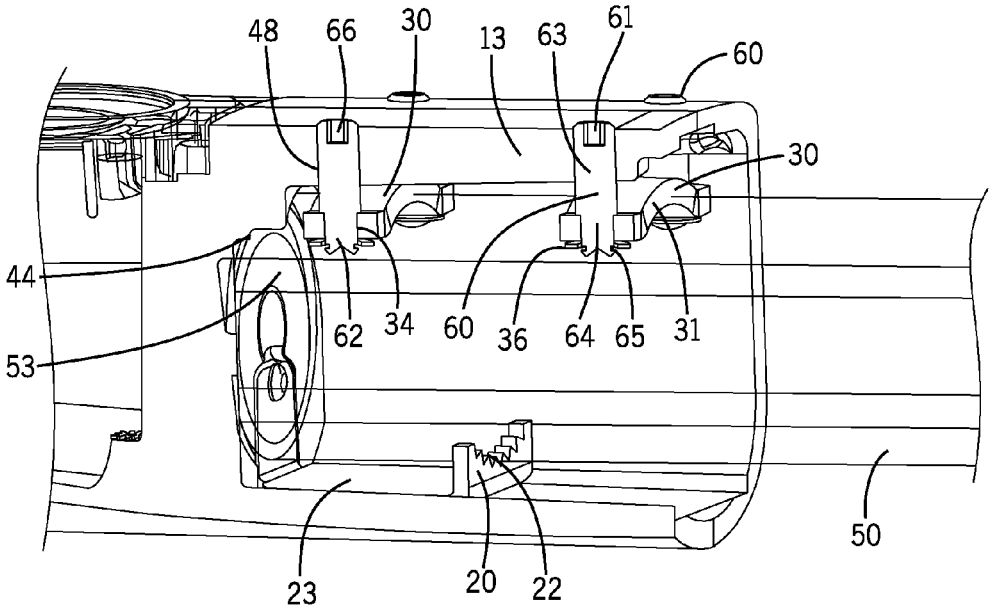
FIG. 6 is a cross-sectional perspective view of the mounting assembly of FIG. 1 taken through the adjustment pins along lines 6-6 seen in FIG. 2.

FIGS. 1, 2 and 6 illustrate fulcrum 20 shaped to limit lateral movement of support member 50 thereagainst. In FIGS. 4 and 6, fulcrum 20 is best shown as including a row of teeth 22 configured to engage support member 50. FIGS. 1, 2, 4 and 6 illustrate each of spaced brackets 30 having a yoke 31 for engagement with elongate support member 50. Each yoke is shown shaped to substantially conform to the shape of support member 50 which is shown as a pipe with a cylindrical cross-section. Support member 50 may also have a rectangular cross-section or any other geometrical configuration and be elongate with a longitudinal axis 52. Fulcrum 20 and engagers 30 may be made to fit specific shapes and sizes of tenons/pipes such that the mounting assembly is customized for fixture installation to a particular support member. Alternatively, the inventive mounting assembly may have a universal configuration to accommodate a wide range of shapes and sizes of tenons/pipes. FIGS. 7-9 further show yoke 31 positioned at selected distances with respect to opposing structure 13 in order to lock elongate support member 50 at a particular angle with respect to longitudinal axis 43.

FIGS. 1-13 show adjustment pins 60 in threaded engagement with a bracket-mounting hole 48 through opposing structure 13 for pushing corresponding yoke 31 against support member 50. FIGS. 1, 2 and 4-6 show a pair of adjustment pins 60 for each yoke 31, one at each end 32 of yoke 31. FIGS. 7-9 show adjustment pin(s) 60 holding corresponding engager 30 at a selected distance with respect to opposing structure 13. FIGS. 4 and 6 show each yoke 31 having a pin-receiving aperture 34 through which corresponding pin 60 extends.

Figure 13:
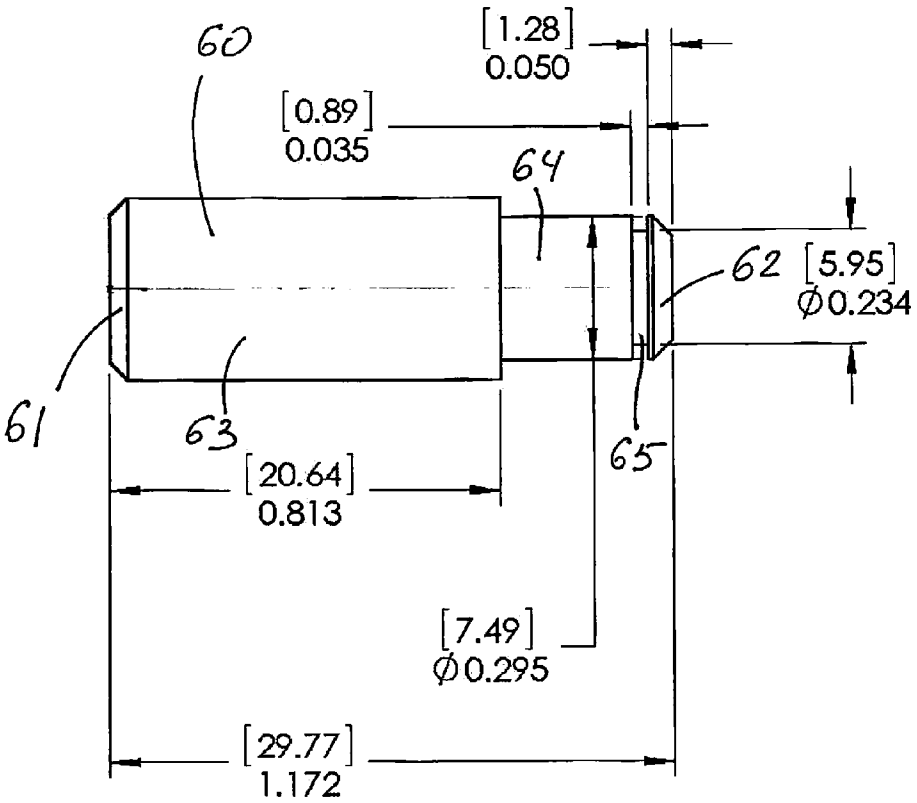
FIG. 13 is an enlarged side elevation of the adjustment pin.

FIG. 13 shows each adjustment pin 60 having first end 61 and second end 62. As best seen in FIGS. 6 and 13, adjustment pins 60 include a threaded shank 63 extending from first end 61 and a shaft portion 64 extending from threaded shank 63 to second distal end 62. FIGS. 6 shows threaded shank 63 in threaded engagement with opposing structure 13 and shaft portion 64 of corresponding pin 60 extending through pin-receiving aperture 34 of corresponding bracket 30. FIGS. 6 and 13 further show shaft portion 64 having a ring-engaging feature 65 at second end 62. As seen in FIG. 6, a retaining ring 36 is held on pin 60 by ring-engaging feature 65. Ring 36 retains engager 30 on pin 60 prior to engagement of engager 30 with support member 50.

Figure 12:
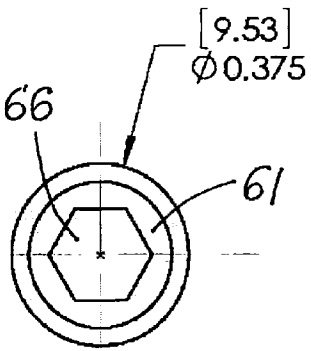
FIG. 12 is an enlarged plan view of a first end of an adjustment pin.

FIGS. 1-14 show first end 61 of each pin 60 being headless. FIGS. 6, 12 and 13 best show first end 61 having a wrench-engaging recess 66. FIGS. 6-9 best illustrate pins 60 extending through opposing structure 13 such that pin 60 may be fully recessed into opposing structure 13, thus reducing visibility of the mounting hardware while allowing for tilt adjustability of fixture 11.

Figure 16:
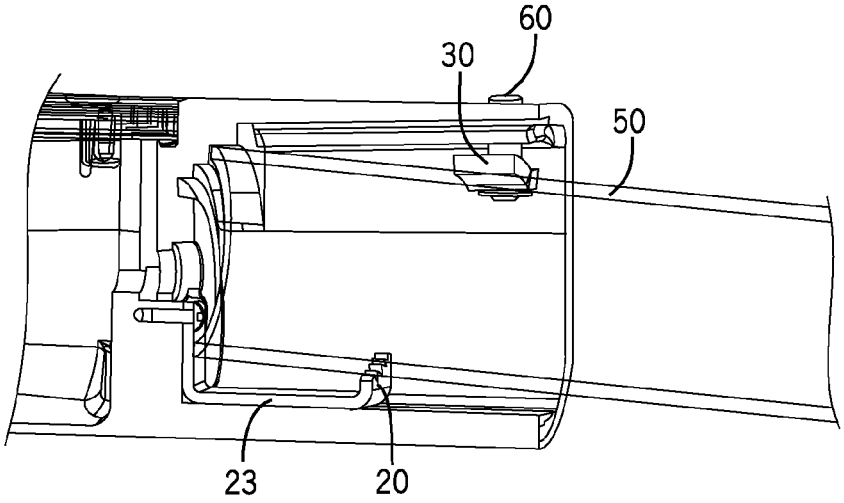
FIG. 16 is a cross-sectional perspective view of an alternative embodiment of the mounting assembly.

FIG. 16 shows an alternative embodiment of inventive mounting assemby 10A which includes engager 30 positioned on one side of fulcrum plane 21 opposite fixture-adjacent end 53. Some other alternative embodiments may have a bracket, including type having the yoke, attached to support member and configured for adjustment of the support member to hold the fixture in the desired orientation.

Figure 17:
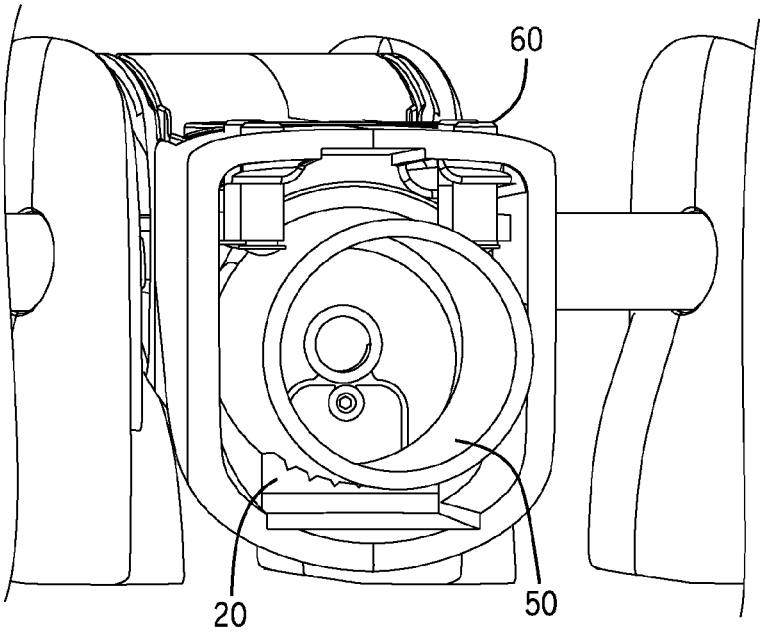
FIG. 17 is a rear perspective view of another alternative embodiment of the inventive mounting assembly.

FIG. 17 illustrates another alternative embodiment of inventive mounting assemby 10B in which adjustment pins 60 engage support member 50 to hold support member 50 to position fixture 11 in the desired orientation.

It should be understood that some embodiments may have one or more adjustment pins which may directly engage(s) support member 50, including by threaded engagement with support member.

While the principles of the invention have been shown and described in connection with specific embodiments, it is to be understood that such embodiments are by way of example and are not limiting.

The invention claimed is:

1. A mounting assembly for securing a fixture in a desired orientation, the assembly comprising:

a fulcrum member and an opposing structure positioned to receive a support member therebetween, the opposing structure extending from a fixture-adjacent end wall secured to the fixture, the fulcrum member having a mounting portion secured to the fixture-adjacent end wall and an extension portion extending from the mounting portion to a fulcrum which protrudes from the extension portion, the fulcrum defining a fulcrum plane and being positioned to pivotably engage one side of the support member; and at least one adjustable engager separately secured to an opposing structure of a surrounding wall for engaging the support member at positions spaced from the fulcrum plane, whereby, when the support member is received between the fulcrum and the engager, adjustment of the engager holds the fixture in the desired orientation.

2. The mounting assembly of claim 1 wherein the fixture is a luminaire.

3. The mounting assembly of claim 1 wherein the fulcrum is shaped to limit lateral movement of the support member thereagainst.

4. A mounting assembly for securing a fixture in a desired orientation, the assembly comprising:

a fulcrum and an opposing structure positioned to receive a support member therebetween, the opposing structure being a portion of a mount housing which is a separate structure removably secured with respect to the fixture for receiving the support member therein, the fulcrum being positioned within the mount housing to pivotably engage one side of the support member; and at least one adjustable engager separately secured to the opposing structure for engaging the support member at position spaced from the fulcrum plane, whereby, when the support member is received between the fulcrum and the engager, adjustment of the engager holds the fixture in the desired orientation.

5. The mounting assembly of claim 4 wherein the mount housing includes a fixture-adjacent end wall and a surrounding wall which extends from the end wall and includes the opposing structure.

6. The mounting assembly of claim 5 wherein the fulcrum is part of a fulcrum member having a mounting portion secured to the end wall and an extension portion extending from the mounting portion along the surrounding wall to the fulcrum which protrudes from the extension portion.

7. The mounting assembly of claim 6 wherein the fulcrum is shaped to limit lateral movement of the support member thereagainst.

8. The mounting assembly of claim 7 wherein the fulcrum includes a row of teeth configured to engage the support member.

9. The mounting assembly of claim 7 wherein the adjustable engager includes a yoke shaped to substantially conform to the shape of the support member.

10. The mounting assembly of claim 1 wherein the opposing structure is a portion of a mount housing secured with respect to the fixture for receiving the support member therein, the mount housing having a longitudinal axis and includes an angle-referencing region shaped to engage the fixture-adjacent end of the support member to facilitate positioning of the mount housing within one of plural predetermined angle ranges with respect to the support member.

11. The mounting assembly of claim 10 wherein:

the mount housing includes the fixture-adjacent end wall and a surrounding wall which extends from the end wall and includes the opposing structure; and the angle-referencing region has a step-like configuration adjoining the end wall with steps each corresponding to one of the plural predetermined angle ranges.

12. The mounting assembly of claim 11 wherein the predetermined angle ranges include ranges of about −5° to about 0°, about 0° to less than +5° and about +5° such that, depending on which of the steps is selected for engagement by the fixture-adjacent end of the support member, adjustment of the adjustable engager locks the mount housing at a particular angle with respect to the support member within the range of the selected step.

13. The mounting assembly of claim 1 comprising a pair of the adjustable engagers each separately secured to the opposing structure, one on either side of the fulcrum plane.

14. The mounting assembly of claim 13 wherein the adjustable engagers are spaced brackets adjustably secured with respect to the opposing structure, each of the spaced brackets having a yoke for engagement with the support member, the yoke being positioned at a selected distance with respect to the opposing structure.

15. The mounting assembly of claim 14 further including, for each yoke, at least one adjustment pin in threaded engagement with the opposing structure for pushing the corresponding yoke against the support member.

16. The mounting assembly of claim 15 including a pair of adjustment pins for each yoke, one at each end of the yoke.

17. The mounting assembly of claim 15 wherein:

each yoke has a pin-receiving aperture through which a corresponding pin extends to terminate in a distal end beyond the yoke;

a ring-engaging feature is at the distal end of the pin; and a retaining ring is held on the pin by the ring-engaging feature, whereby the ring retains the yoke on the pin prior to engagement of the yoke with the support member.

18. The mounting assembly of claim 17 including a pair of adjustment pins for each yoke, one at each end of the yoke.

19. The mounting assembly of claim 1 wherein:

the adjustable engagers are spaced brackets adjustably secured with respect to the opposing structure, each of the spaced brackets having a yoke for engagement with the support member; and for each bracket, there is at least one adjustment pin holding the corresponding bracket at a selected distance with respect to the opposing structure.

20. The mounting assembly of claim 19 including a pair of adjustment pins for each yoke, one at each end of the yoke.

21. The mounting assembly of claim 19 wherein:

each adjustment pin has first and second ends and includes:

a threaded shank extending from the first end in threaded engagement with the opposing structure; and a shaft portion extending from the threaded shank to the second end, the shaft portion having a ring-engaging feature at the second end; and a retaining ring is held on the pin by the ring-engaging feature.

22. The mounting assembly of claim 21 wherein each bracket has a pin-receiving aperture with the shaft portion of a corresponding pin extending therethrough, the ring retaining the bracket on the pin prior to engagement of the bracket with the support member.

23. The mounting assembly of claim 21 wherein the first end of the pin is headless and has a wrench-engaging recess.

24. A mounting assembly for securing a fixture in a desired orientation, the assembly comprising:

a fulcrum and an opposing structure each secured with respect to the fixture and positioned to receive a support member therebetween, the fulcrum defining a fulcrum plane and being positioned to pivotably engage one side of the support member, the fulcrum being part of a fulcrum member having a mounting portion secured with respect to the fixture and an extension portion extending from the mounting portion to the fulcrum which protrudes from the extension portion; and at least one adjustable engager separately secured to the opposing structure for engaging the support member at position spaced from the fulcrum plane, whereby, when the support member is received between the fulcrum and the engager, adjustment of the engager holds the fixture in the desired orientation.

25. The mounting assembly of claim 24 wherein the fulcrum is shaped to limit lateral movement of the support member thereagainst.

26. The mounting assembly of claim 25 wherein fulcrum includes a row of teeth configured to engage the support member.

27. The mounting assembly of claim 26 wherein each of the adjustable engagers includes a bracket shaped to substantially conform to the shape of the support member.

* * * * *